US010030934B2

(12) United States Patent
Metayer

(10) Patent No.: US 10,030,934 B2
(45) Date of Patent: Jul. 24, 2018

(54) MODULAR GUN HOLSTER

(71) Applicant: Lugol Metayer, Hephzibah, GA (US)

(72) Inventor: Lugol Metayer, Hephzibah, GA (US)

( * ) Notice: Subject to any disclaimer, the term of this patent is extended or adjusted under 35 U.S.C. 154(b) by 0 days.

(21) Appl. No.: 15/427,117

(22) Filed: Feb. 8, 2017

(65) Prior Publication Data

US 2017/0227324 A1 Aug. 10, 2017

Related U.S. Application Data

(60) Provisional application No. 62/292,972, filed on Feb. 9, 2016.

(51) Int. Cl.
*F41C 33/02* (2006.01)
*F41C 33/04* (2006.01)

(52) U.S. Cl.
CPC ..... *F41C 33/0209* (2013.01); *F41C 33/041* (2013.01); *F41C 33/048* (2013.01); *F41C 33/02* (2013.01)

(58) Field of Classification Search
CPC .... F41C 33/02; F41C 33/0209; F41C 33/048; F41C 33/0254; A45F 2200/0591
See application file for complete search history.

(56) References Cited

U.S. PATENT DOCUMENTS 7,290,688 B2 * 11/2007 Pikielny ..... F41C 33/0209 224/163
7,739,824 B1 * 6/2010 Swan ..... F41G 11/003 42/124
9,267,760 B2 * 2/2016 Slinkard ..... F41C 33/043
9,404,710 B1 * 8/2016 Beard ..... F41C 33/0209
9,523,558 B2 * 12/2016 Visinski ..... F41C 27/00
9,568,275 B2 * 2/2017 Sykes ..... F41C 33/0236
9,581,413 B2 * 2/2017 Massaro, Jr. ..... F41C 33/04
2003/0141328 A1 * 7/2003 Cragg ..... A45F 5/021 224/192
2005/0205621 A1 9/2005 Shults
2014/0027486 A1 1/2014 McGee
2014/0158733 A1 6/2014 McDonnell
2016/0216065 A1 * 7/2016 Tedder ..... F41C 33/0263
2017/0067720 A1 * 3/2017 Visinski ..... F41G 11/003
2017/0153087 A1 * 6/2017 Massarro, Jr. ..... F41C 33/04
2017/0227324 A1 * 8/2017 Metayer ..... F41C 33/0209
2017/0231372 A1 * 8/2017 Metayer ..... A45F 5/00 224/222

* cited by examiner

*Primary Examiner* — Justin Larson
(74) *Attorney, Agent, or Firm* — GrayRobinson, P.A.

(57) ABSTRACT

A handgun holster for use by a wearer comprising a base plate having an outside plate face, a body plate face, and outer edge, a detachable firearm pocket on the plate for receiving a handgun, the pocket further comprising a front side and a back side, a top side wherein the top side has a notch having a radius such that when the handgun having a trigger and a trigger guard is placed in the firearm pocket, the trigger guard is uncovered by the firearm pocket and the trigger is covered by the firearm pocket, at least one accessory holder, wherein the rail is separately detachable from the pocket through a latch connection, and at least one latch connection, the latch connections comprising a rail and latch system, a layer of intermediate foam behind the plate, a layer of elastic foam behind the layer of intermediate foam wherein the layer of elastic foam overlaps the outer edge of the plate.

11 Claims, 5 Drawing Sheets

MODULAR GUN HOLSTER

CROSS-REFERENCE TO RELATED INVENTIONS

This application claims the benefit of provisional application No. 62/292,972, filed Feb. 9, 2016, the disclosure of which is incorporated by reference herein.

BACKGROUND OF THE INVENTION

Field of the Invention

The present invention relates to a holster. More specifically, the present invention relates to a handgun holster designed with a modular hard plastic gun pocket and accessory connections.

Description of the Background Art

Holsters that carry a handgun or similarly weapon are generally a single piece that can clip onto a user's belt or the waistline of a pair of pants or can be held against the user with a strap. These holsters can be very uncomfortable as they are generally made of a type of plastic and can have rough or uneven edges. Furthermore, these holsters are static when it comes to their design. That is, the angle and shape of the gun pocket is set once the holster has been manufactured. In order to get a different style, a user would need to purchase a completely separate holster. There presently exists a need in the art for a comfortable gun holster with modular capabilities.

For example, United States Patent Application Publication 2014/0027486 to McGee et al. describes a concealment holster. The backside of the holster has a foam backing material to eliminate discomfort such as hotspots and has a spacer mesh material that is antibacterial and antimicrobial to wick away moisture. However, McGee does not describe a holster with modular capabilities such that the gun pocket can be changed at will. The user is stuck with the manufactured design. The present invention features a gun pocket as well as accessory holder that is modular and which can be changed at will.

United States Patent Application Publication 2005/0205621 to Shults describes a holster with an accessory holder. In particular, Shults describes a weapon holster with a mounting rail located adjacent to an outer surface of the holster body. The holster is limited to the one accessory holder and the holster itself does not feature an interchangeable gun pocket. The present invention allows for a user to actively change out the gun pocket as well as create additional accessory holders through either the use of the underlying rail system or through the use of a gun pocket having accessory holders attached.

United States Patent Application Publication 2014/0158733 to McDonnell describes a concealed carry firearm holster. In particular, McDonnell describes a holster with a leather backing having a housing that is connected to the backing panel by screws, rivets, glue, snaps, and other means. These connection means do not provide the ability to quickly detach the housing such that a user can change the housing at will. Screws, rivets, glue, snaps, and other similar means all require effort and time to remove. The present invention uses a novel latch system to securely connect the gun pocket to the base. McDonnell's leather backing is also inadequate as leather can cause chafing and become uncomfortable in certain situations. The present invention uses an elastic foam backing that conforms to the user's body shape for maximum comfort.

Therefore, it is an object of this invention to provide an improvement which overcomes the aforementioned inadequacies of the prior art devices and methods and provides an improvement which is a significant contribution to the advancement of the gun holster art.

Another object of this invention is to provide a holster having a comfortable backing that conforms to the shape of the user's torso or upper hip area preventing uncomfortable edges.

Another object of this invention it to provide a modular system that allows users to freely change the gun pocket design and layout of the holster.

Another object of this invention is to provide a modular system that allows users to freely change the number of accessory holder designs and layouts on the holster.

Another object of this invention is to provide a holster having a gun pocket made out of a thermoplastic acrylic-polyvinyl chloride, preferably Kydex®, such that the holster will not be easily damaged from day-to-day wear and tear.

Another object of this invention is to provide a holster that uses a variety of gun pockets to accommodate a variety of different gun styles.

Another object of this invention is to provide a holster that can be easily and conveniently disassembled and reassembled using the same or different layout without the use of other tools.

The foregoing has outlined some of the pertinent objects of this invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a handgun holster for use by a wearer comprising a base plate having an outside plate face, a body plate face, and outer edge, a detachable firearm pocket on the plate for receiving a handgun, the pocket further comprising a front side and a back side, a top side wherein the top side has a notch having a radius such that when the handgun having a trigger and a trigger guard is placed in the firearm pocket, the trigger guard is uncovered by the firearm pocket and the trigger is covered by the firearm pocket, at least one accessory holder, wherein the rail is separately detachable from the pocket through a latch connection, and at least one latch connection, the latch connections comprising a rail and latch system, a layer of intermediate foam behind the plate, a layer of elastic foam behind the layer of intermediate foam wherein the layer of elastic foam overlaps the outer edge of the plate. The accessory holder may hold other items such as knives, cell phones, or any other object so long as it can use the rail system described herein.

The rail system used for the accessory holder and to hold the pocket in place is generally of the Picatinny style but may be any rail system which supports gun accessories such as a Weaver, Keymod, or M-Lok rails. The rail system is kept in place through the use of latches that lock the pocket and any accessory holder into place and prevents movement.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures and methods for carrying out the same purposes of the present invention. It should also be realized by those skilled in the art that such equivalent constructions and methods do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The following description is of a preferred embodiment presently contemplated for carrying out the invention. This description is not to be taken in a limiting sense, but is made merely for the purpose of describing one or more preferred embodiments of the invention. The scope of the invention should be determined with reference to the claims.

Figure 1:
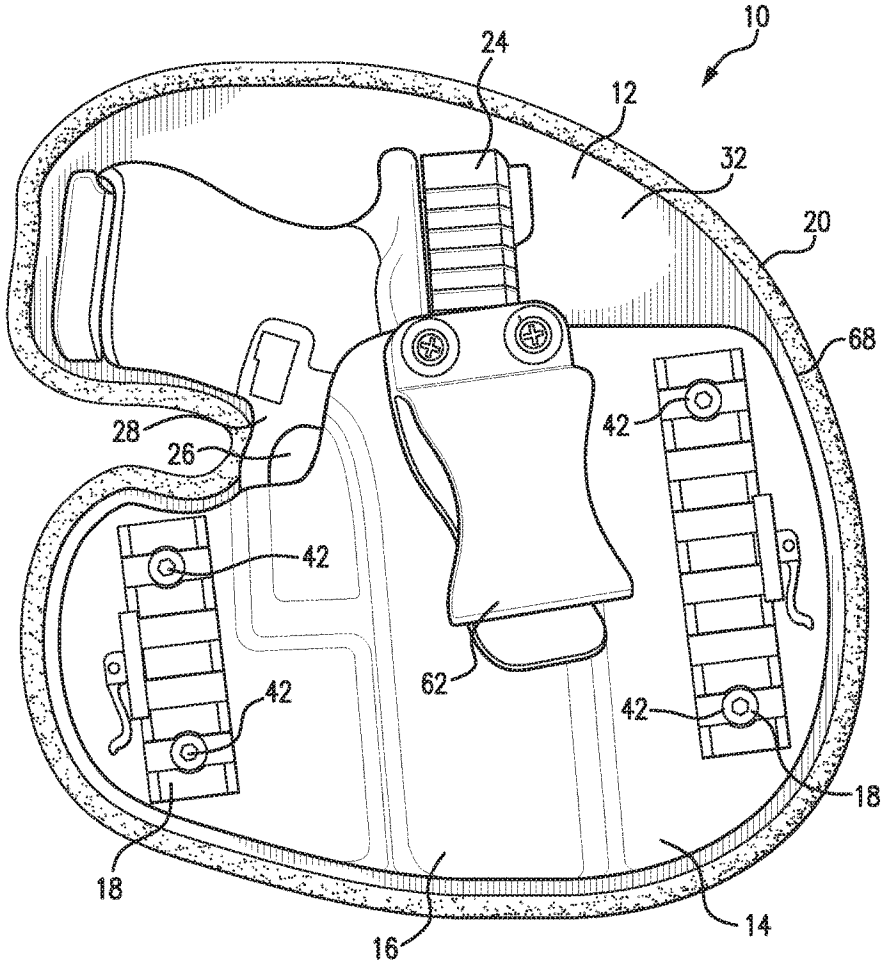
FIG. 1 illustrates a front view of an embodiment.

In FIG. 1, the firearm holster 10 comprises generally of a back plate 12 and firearm pocket 14. The firearm pocket 14 itself comprises of a firearm slot 16 specifically molded for particular styles of weapons and at least one rail locking mechanism 18, described in further detail below. The back plate 12 has an outside plate face 32 and a body plate face 34. A elastic foam lining 20 lines the outside plate edge 22 of the back plate 12 and provides cushioning and support for when the firearm holster 10 is in place against a user's body. The elastic foam lining 20 lines the entire body plate face 34 of the back plate 12 The elastic foam lining 20 generally conforms to the shape of the user's body for maximum comfortability. When a firearm 24 is in place in the firearm slot 16, a user will have quick access to the weapon due to the notch 26 taken out of the firearm pocket 14. The notch 26 exposes the firearm trigger guard 28 but keeps the firearm trigger 30 safely encased. This allows a user to quickly, yet safely, access the firearm 24 without risking a misfire. The firearm pocket 14 is preferably made out of a thermoplastic acrylic-polyvinyl chloride such as Kydex® but may be made out of any suitable durable and moldable hard plastic. Similarly, the back plate 12 may be made out of a similar material or a different material as the firearm pocket 14. The firearm pocket 14 may also have a belt clip 62 to provide for further stability when engaged with a wearer.

Figure 2:
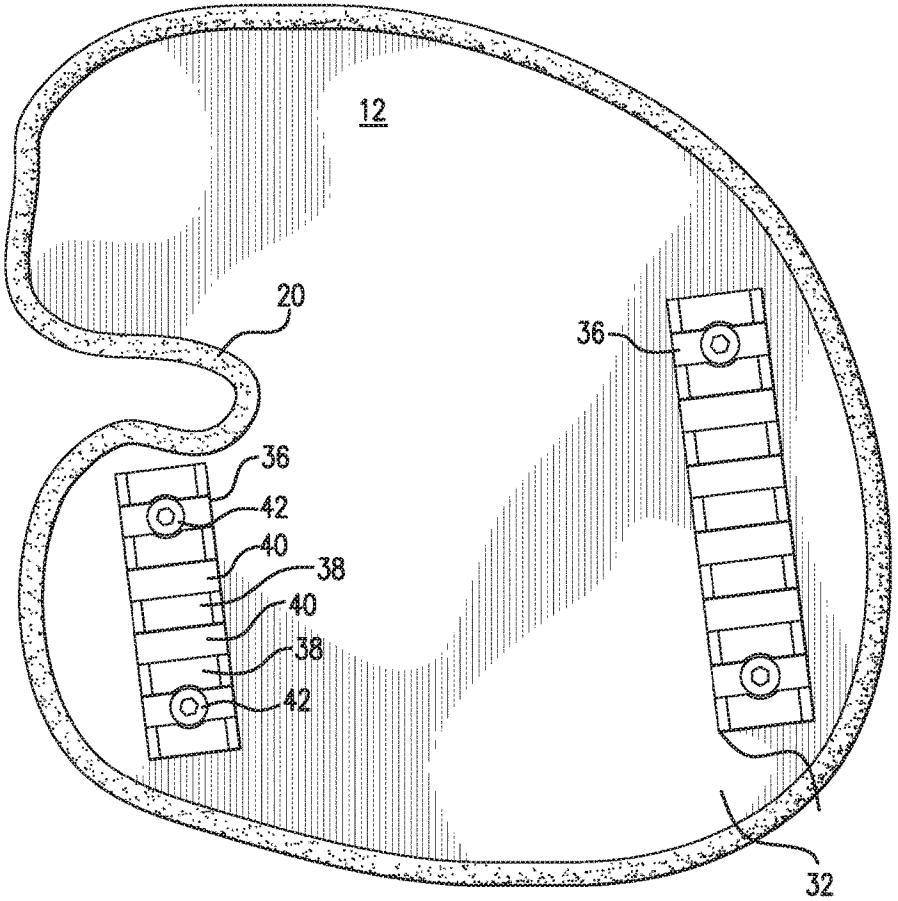
FIG. 2 illustrates the holster without a firearm pocket attached.

FIG. 2 shows the back plate 12 when the firearm pocket 14 and firearm 24 have been removed. What remains is the back plate 12, elastic foam lining 20, and at least one lower locking rail portion 36. The lower locking rail portion 36 comprises a series of slots 38 and ridges 40. These slots 38 and ridges 40 are generally of the Picatinny style but may be any type of rail system generally used to hold firearm accessories such as Weaver-style rails. The ridge 40 generally have extensions 62 that extend longitudinally outward. The lower locking rail portion 36 may be held in place in any number of ways presently known or unknown. As shown in FIG. 2, the lower locking rail portion 36 is held in place by a series of screws 42 but attachment can be made through the use of bolts, buttons, lugs, nails, snaps, or any other means. The upper locking rail portion 44 may have a series of apertures 66 to allow for access to the screws 42 or other attachment means.

Figure 3:
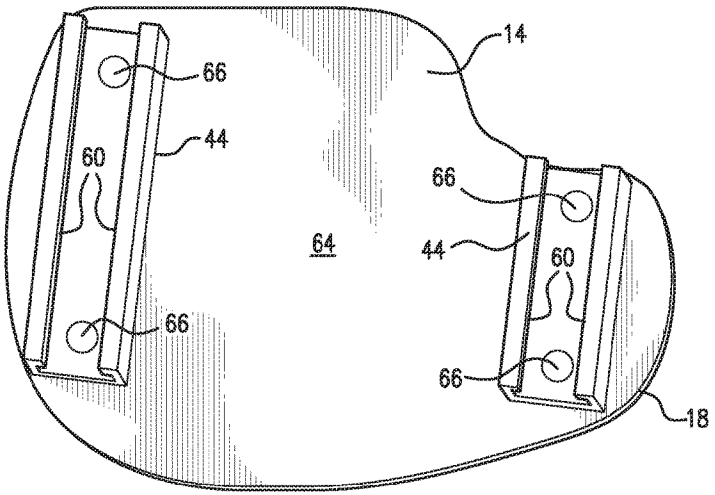
FIG. 3 illustrates a rear view of the firearm pocket.

FIG. 3 shows the back face 44 of the firearm pocket 14. Integrally molded into the firearm pocket 14 is at least one upper locking rail portion 44. The upper locking rail portion 44 allows for the firearm pocket 14 to slide onto the lower locking rail portion 36 or for the firearm pocket 14 to be laid directly on top of the lower locking rail portion 36 and snap into place. Preferably, the upper locking rail portion 44 is made of the same material as the firearm pocket 14 but may also be a less durable plastic so as to facilitate the attachment of the firearm pocket 14 to the back plate 12.

Figure 4:
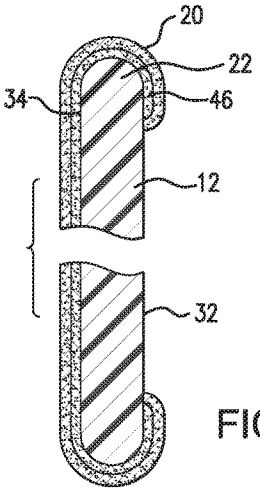
FIG. 4 illustrates a cross-sectional view of the holster and foam backing.

FIG. 4 shows a cross-sectional view of the back plate 12. As shown, the elastic foam lining 20 and the back plate 12 are generally layered and have an intermediate foam backing 46 in between the two layers. Both the elastic foam lining 20 and the intermediate foam backing 46 have breathable ventilation features such as small pores throughout the material that allow for wicking away of moisture and further comfort for the user. The intermediate foam backing 46 may be the same or different foam material as the elastic foam lining 20 but can have a different foam density, depending on the preference of the wearer. Preferably, the thickness of the intermediate foam backing 46 and the elastic foam lining 20 in combination is between 0.5 and 2.5 millimeters thick but may be greater depending on the preference of the user.

Figure 5:
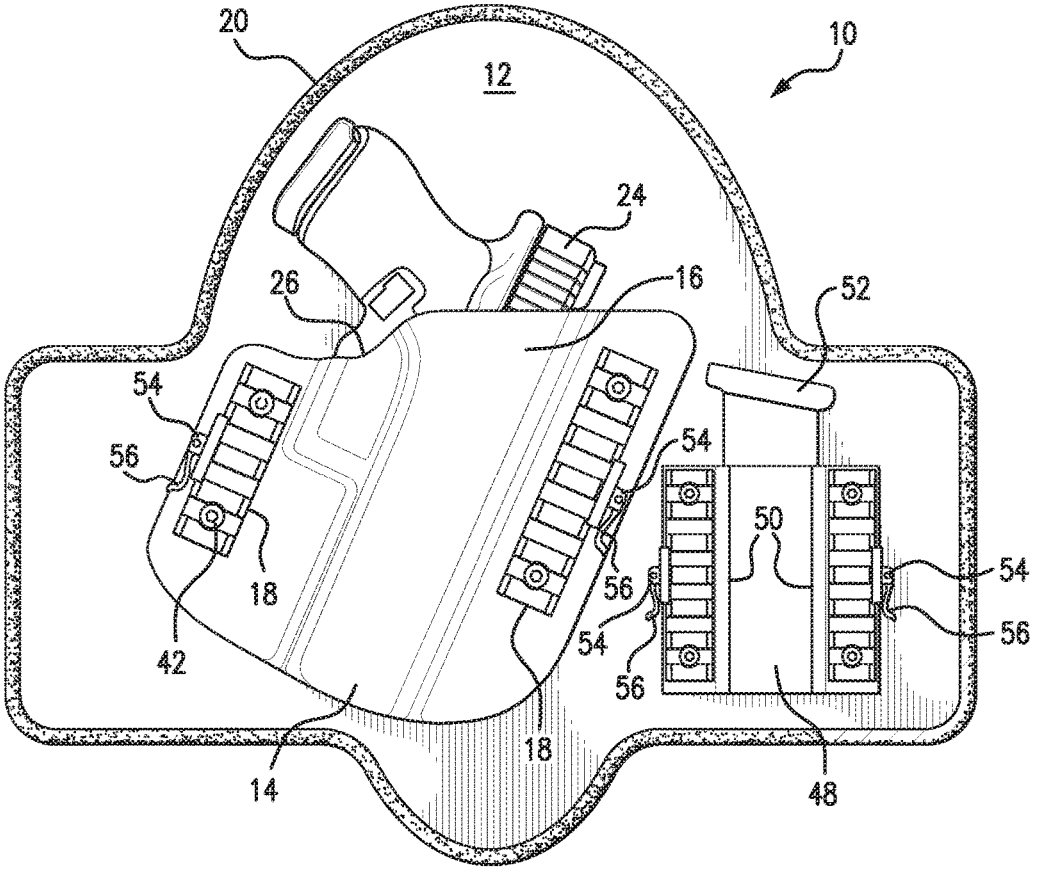
FIG. 5 illustrates a front view of a second embodiment.

FIG. 5 shows an alternative embodiment of the present invention. The back plate 12 may be extended to provide space for an accessory holder 48. The accessory holder 48 shown is holding an extra magazine or clip of ammunition 52 for the firearm 24 being held in the firearm holster 10. The accessory holder 48 uses a secondary rail locking mechanism 50 that follows the same principles as the rail locking mechanism 18 used for the firearm pocket 14, described below. The accessory holder 48 is not limited to magazines and may be used for any number of firearms accessories. The accessory holder 48 can be molded into any shape required for an accessory and is as modular as the firearm pocket 14 due to the large variety of weapons and their accessories that are currently on the market. Accessories can include magazines, knives, scopes, and even cell phones. Similarly, the shape of the back plate 12, as shown in this alternative embodiment, may take different shapes depending on the level of interchangeability desired by the wearer. A wearer only desiring to carry a firearm 24 around may only need the firearm holster 10 shown in FIGS. 1-4. A wearer desiring to carry said firearm's 24 accessories around as well may need the firearm holster 10 shown in FIG. 5. The portions outlined with dotted lines are the preferred placement for the belt clips 62 but the back plate 12 may have any number of belt clips 62 on its outside plate face 32 in any placement due to the modularity of the design. When in place, the firearm pocket 14 and the firearm pocket edge 68 form a low profile with the outside plate edge 22 and elastic foam lining 20 so that, when a wearer uses the firearm holster 10, the weapon remains concealed from any onlooker. Any number of designs for the back plate 12 may be used that would still comport with the spirit and scope of this invention.

Figure 6A:
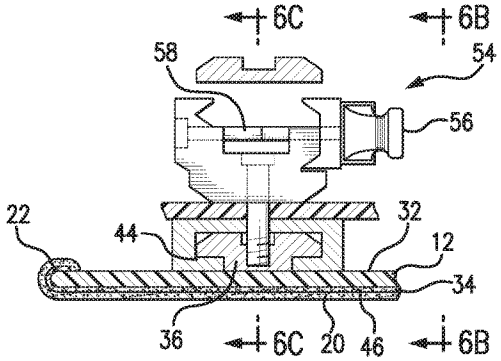
FIG. 6A illustrates a close-up exploded view of the rail and latch system holding the gun pocket and optional accessory holder in place.
Figure 6B:
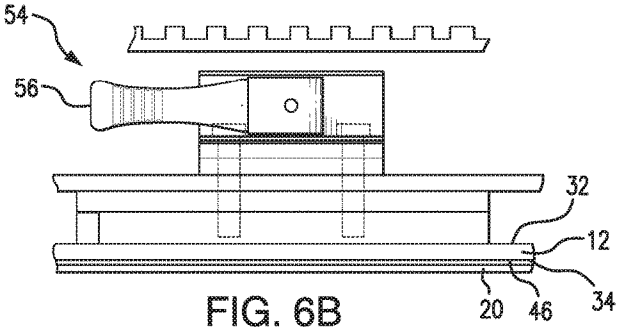
FIGS. 6B and 6C illustrate a perspective and cross-sectional view respectively of the latch system.
Figure 6C:
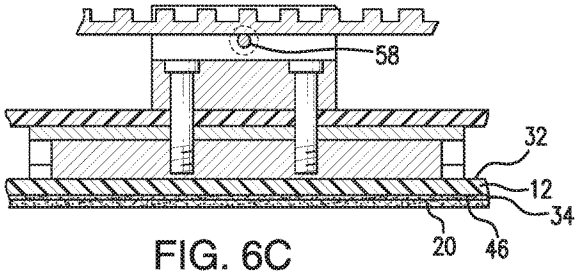

FIG. 6A-6C shows in further detail the rail locking mechanism 18 used for the firearm pocket 18 and the accessory holder 48. The rail locking mechanism 18 comprises a latch 54 having a handle 56 and locking piston 58. When the upper locking rail portion 44 is in place on top of the lower locking rail portion 36, the wearer can flip the latch 54 into the locked configuration, as shown in FIGS. 6A-6C. The locking piston 58 engages with the slots 38 of the lower rail locking mechanism 36 and prevents side to side movement. The arms 60 extending from walls 70 of the upper locking rail portion 44 hold the firearm pocket 14 in place vertically and prevents the firearm pocket 14 from being lifted off the back plate 12 accidentally. The latch system is essentially described in U.S. Pat. No. 7,739,824 to Swan, the entirety of which is hereby incorporated by reference.

The invention being described, it will be obvious that the same may be varied in many ways. Such variations are not to be regarded as a departure from the spirit and scope of the invention, and all such modifications as would be obvious to one of ordinary skill in the art are intended to be included within the scope of the following claims.

What is claimed is:

1. A holster comprising:

a back plate further comprising an outside plate face and a body plate face wherein said body plate face is layered with an intermediate foam backing and an elastic foam lining which wraps around an edge of the outside plate face;

a lower locking rail portion attached to the outside plate face comprising a plurality of slots and ridges with each ridge having a plurality of extensions extending longitudinally outward for engaging an upper locking rail portion;

a firearm pocket comprising a moldable plastic and further comprising a firearm slot, a notch which covers a trigger, and the upper locking rail portion wherein the upper locking rail portion comprises walls and engageable arms for engaging with the extensions of the lower locking rail portion; and a rail locking mechanism attached to the lower locking rail portion comprising a latch having a handle and locking piston which engages the slots of the lower locking rail portion when the firearm pocket is in a desired position.

2. The holster of claim 1 wherein the firearm pocket is made of a thermoplastic acrylic-polyvinyl chloride.

3. The holster of claim 1 wherein the back plate further comprises an accessory holder attached to the back plate using a secondary rail locking mechanism.

4. The holster of claim 1 wherein the back plate further comprises a plurality of belt clips attached to the firearm pocket.

5. The holster of claim 1 wherein the intermediate foam backing and the elastic foam lining comprise a plurality of small pores for ventilation having a thickness between 0.5 and 2.5 millimeters.

6. The holster of claim 1 wherein the lower locking rail portion is attached to the back plate using attachment means.

7. The holster of claim 1 wherein the lower locking rail portion has at least one aperture.

8. The holster of claim 7 wherein the aperture allows for the attachment of the lower locking rail portion using attachment means.

9. A holster comprising:

a back plate further comprising an outside plate face and a body plate face wherein said body plate face is layered with an intermediate foam backing and an elastic foam lining which wraps around an edge of the outside plate face;

a lower locking rail portion attached to the outside plate face comprising a plurality of slots and ridges with each ridge having a plurality of extensions extending longitudinally outward for engaging an upper locking rail portion;

a firearm pocket comprising a moldable plastic and further comprising a firearm slot, a notch which covers a trigger, and the upper locking rail portion wherein the upper locking rail portion comprises walls and engageable arms for engaging with the extensions of the lower locking rail portion;

a rail locking mechanism attached to the lower locking rail portion comprising a latch having a handle and a locking piston which engages the slots of the lower locking rail portion when the firearm pocket is in a desired position; and an accessory holder for holding an accessory attached to the back plate using a secondary locking mechanism further comprising a secondary lower locking rail portion, said secondary lower locking rail portion comprising a plurality of secondary slots and secondary ridges, a secondary upper locking rail portion, said secondary upper locking rail portion comprising walls and engageable arms, and a secondary rail locking mechanism comprising a secondary latch having a secondary handle and a secondary locking piston which engages the secondary slots of the secondary lower locking rail portion when the accessory holder is in a desired position.

10. The holster of claim 9 wherein the firearm pocket is made of thermoplastic acrylic-polyvinyl chloride.

11. The holster of claim 9 wherein the intermediate foam backing and the elastic foam lining comprise a plurality of small pores for ventilation having a thickness between 0.5 and 2.5 millimeters.

* * * * *